US005725294A

United States Patent [19]

Froelicher

[11] Patent Number: 5,725,294

[45] Date of Patent: Mar. 10, 1998

[54] ANTISWEAT REFRIGERATOR CABINET

[75] Inventor: Stephen Bernard Froelicher, Louisville, Ky.

[73] Assignee: General Electric Company, Louisville, Ky.

[21] Appl. No.: 784,329

[22] Filed: Jan. 15, 1997

Related U.S. Application Data

[63] Continuation of Ser. No. 413,247, Mar. 30, 1995.

[51] Int. Cl.[6] ..... A47B 96/04

[52] U.S. Cl. ..... 312/401; 312/400; 312/406; 62/453

[58] Field of Search ..... 312/400, 401, 312/405, 406, 406.1, 406.2, 116, 296, 236; 49/478.1, 501; 220/467; 62/273, 277, 13, 451, 452, 453

[56] References Cited

U.S. PATENT DOCUMENTS

| | | | |
|---|---|---|---|
| 3,653,532 | 4/1972 | Mann | 312/406.2 X |
| 3,707,243 | 12/1972 | Kitson | 312/406.2 X |
| 3,805,545 | 4/1974 | Buchser et al. | 62/443 |
| 4,006,947 | 2/1977 | Haag et al. | 312/406 |
| 4,583,378 | 4/1986 | Sakamoto et al. | 62/505 |
| 5,082,335 | 1/1992 | Cur et al. | 312/401 |
| 5,171,079 | 12/1992 | Bayerle | 312/400 X |
| 5,269,154 | 12/1993 | Schmidt | 62/275 |
| 5,277,035 | 1/1994 | Fristoe et al. | 62/453 X |
| 5,398,510 | 3/1995 | Gilley et al. | 62/3.6 |

FOREIGN PATENT DOCUMENTS

| | | | |
|---|---|---|---|
| 2103382 | 4/1990 | Japan | 312/400 |
| 2242075 | 9/1990 | Japan | 312/400 |
| 757520 | 9/1956 | United Kingdom | 312/406 |

*Primary Examiner*—Peter M. Cuomo
*Assistant Examiner*—James O. Hansen
*Attorney, Agent, or Firm*—H. Neil Houser

[57] ABSTRACT

A refrigerator includes a front face surrounding the front openings of the storage compartments. Operation of the refrigerator tends to cause some portions of the face to be colder than the dew point temperature of the surrounding air. Moisture in the surrounding air tends to condense on such colder than dew point portions. Sheets of aluminum foil are in intimate contact with the inside of the case, extend along those portions of the face subject to condensation and project onto adjacent areas of the case which are warmer than the dew point temperature. This keeps the temperature of those portions subject to condensation above the dew point temperature. Portions of the doors, such as the adjacent peripheral walls of doors on multi-compartment units, also may tend to be below the dew point temperature. Sheets of aluminum foil are positioned in intimate contact with the inside of those portions of the doors and project onto adjacent areas of the doors which are warmer than the dew point temperature. This keeps those portions of the doors above the dew point temperature.

17 Claims, 2 Drawing Sheets

Fig. 1
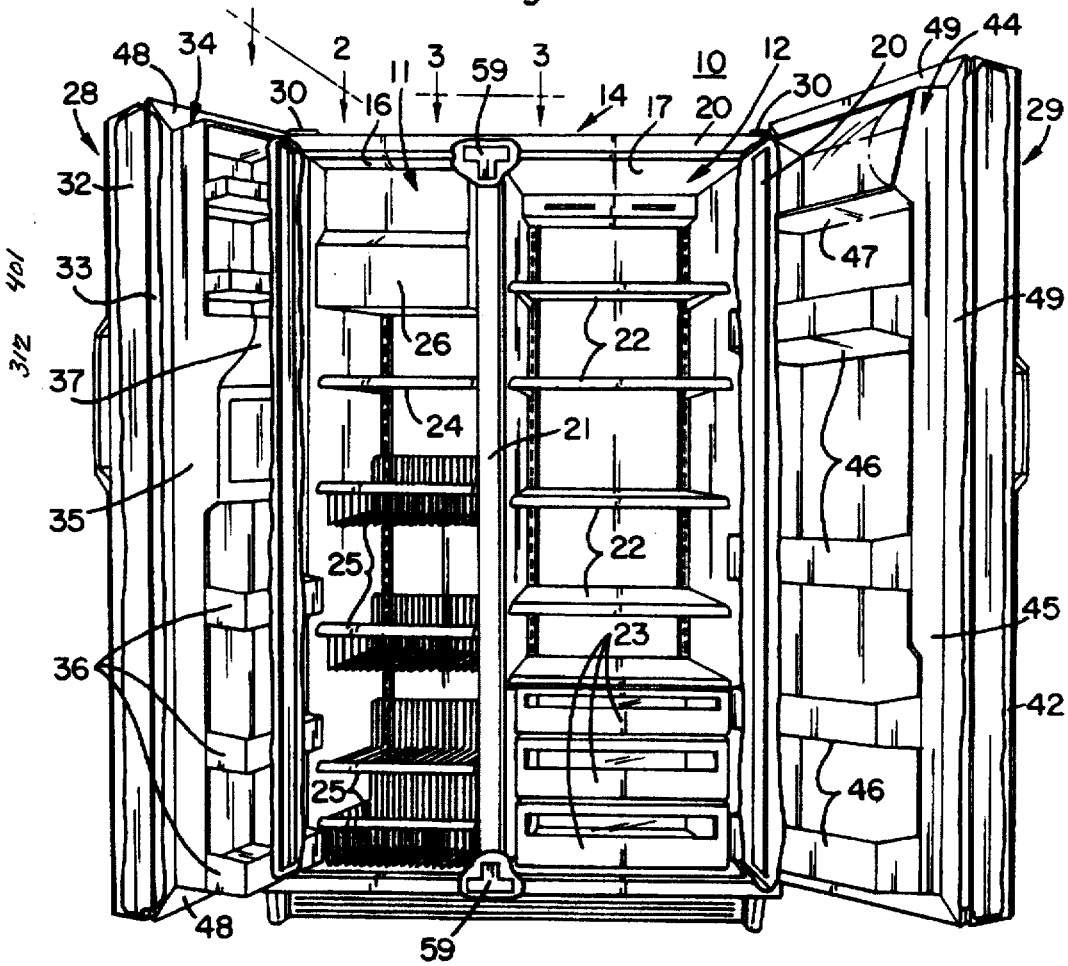
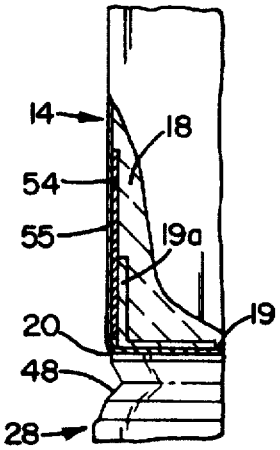
Fig. 2
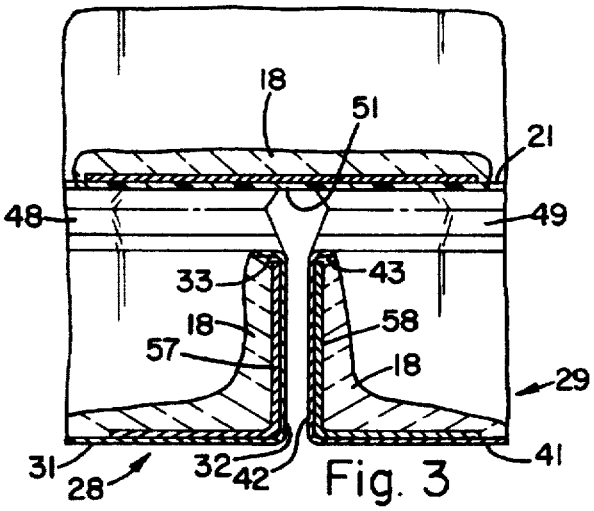
Fig. 3

ANTISWEAT REFRIGERATOR CABINET

This is a continuation of copending application Ser. No. 08/413,247 filed on Mar. 30, 1995 which designated the U.S.

BACKGROUND OF THE INVENTION

A long standing problem with modern refrigerators is condensation on the outside of the cabinet which, results from portions of the cabinet being at a temperature below the dew point temperature of the surrounding air. The low temperature of these cabinet portions is a result of the transfer of thermal energy between the inside of the compartments and the surrounding air across the gasket areas. This causes moisture in the air to condense on those portions of the cabinet. Most commonly such condensation occurs on the front face, and to a lesser degree, on the front portion of the outer case side and top walls adjacent the front edge of the case. It also can occur on the peripheral edges or walls of the doors, particularly the adjacent facing walls of the doors of multi-compartment units.

For a number of years this problem has been attacked by applying additional heat to the areas likely to be affected by condensation. In some refrigerators this is accomplished by an elongated electric heater positioned adjacent the inside of the front face of the cabinet. Similar heaters are positioned inside the doors. In other refrigerators a hot gas loop is positioned inside the front face of the cabinet.

Either approach has a number of drawbacks. Each requires substantial additional material and labor to install. Either source of heat is buried in the foamed insulation and is not accessible after the manufacture of the refrigerator is completed. A hot gas loop complicates the refrigeration system and provides a potential source for a system failure. Electric heaters may not have an expected life as long as that of the refrigerator. Thus manufacturers often install two heaters, with the second to be used only if the first becomes inoperable. This increases the cost of all such refrigerators when only a small per centage of the second heaters will ever be needed. Either approach makes the refrigerator less energy efficient as it requires additional energy to supply the heat and additional energy for the refrigeration system to overcome the additional thermal energy that enters the compartments.

Therefore it is an object of this invention to provide an improved refrigerator in which moisture does not condense on portions of the cabinet adjacent the gasket.

It is another object of this invention to provide such an improved refrigerator which effectively transfers thermal energy from areas of the cabinet above the dew point temperature to portions subject to being below the dew point temperature as a result of refrigeration operation.

SUMMARY OF THE INVENTION

In accordance with one embodiment of the invention a refrigerator comprises an outer case, an inner liner defining a storage compartment, a front face adjacent the compartment access opening and a door for closing the opening. At least a portion of the face is disposed so that operation of the refrigerator tends to cool that portion to a temperature below the dew point temperature of the surrounding air. A thin sheet of high thermal conductivity material, such as aluminum foil for example, is in intimate contact with the inside of the case, extends along that portion of the front face subject to condensation and projects onto an adjacent area of the case having a temperature above the dew point temperature so that the temperature of the front face portion subject to condensation is above the dew point temperature of the surrounding air.

In accordance with another aspect of the invention the temperature of a portion of the peripheral wall of the door tends to be below the dew point temperature of the surrounding air as a result of refrigerator operation. A thin sheet of high thermal conductivity material, such as aluminum foil for example, is in intimate contact with the inside of the door, extends along that portion of the peripheral wall subject to condensation and projects onto an adjacent area of the door having a temperature above the dew point temperature of the surrounding air so that the temperature of the peripheral wall portion subject to condensation is above the dew point temperature of the surrounding air.

BRIEF DESCRIPTION OF THE DRAWINGS

FIG. 1 is a front perspective view of a side-by-side refrigerator with the access doors open and with parts of the front face and doors removed for purposes of illustration.

FIG. 2 is a fragmentary plan view of the upper left front corner portion of the case of the refrigerator as seen along line 2—2 in FIG. 1, with a portion of the outer case broken away for purposes of illustration.

FIG. 3 is a fragmentary plan view of the top center portion of the refrigerator generally as seen along line 3—3 in FIG. 1, but with the doors closed and with portions of the outer case and doors broke/away for purposes of illustration.

DETAILED DESCRIPTION OF PREFERRED EMBODIMENT

Figure 4:
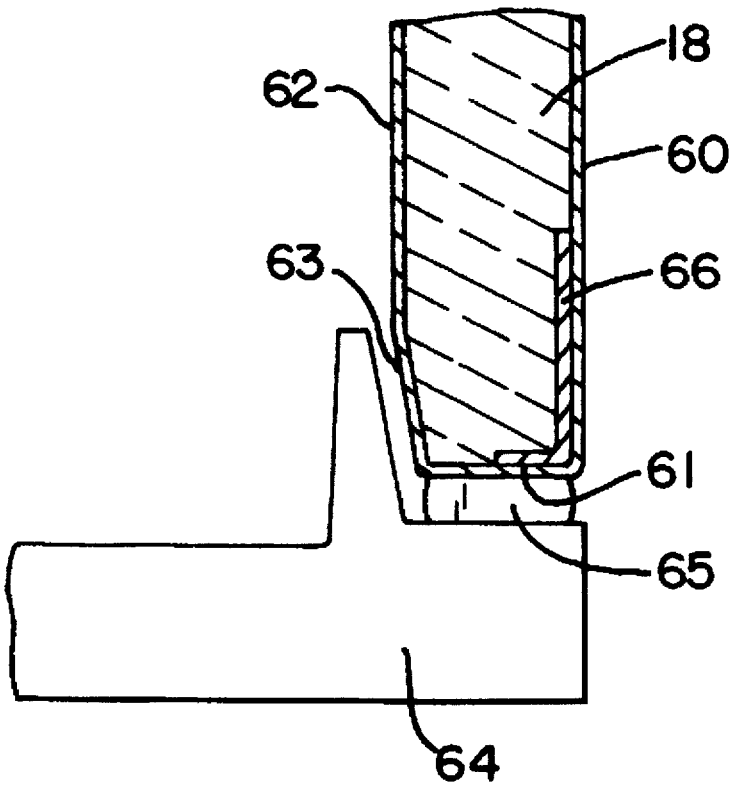
FIG. 4 is a somewhat schematic plan view of the upper right front corner another refrigerator incorporating one embodiment of the present invention.

FIG. 1 illustrates a household refrigerator 10 of the side-by-side type; that is a freezer storage compartment 11 and a fresh food storage compartment 12 are arranged side-by-side within the refrigerator. The refrigerator 10 has a cabinet including an outer case 14 and inner liners 16,17. The space between the case and the liners and between the liners is filled with foamed-in-place insulation 18 (see FIGS. 2–4). The outer case normally is formed by folding a sheet of a suitable material, such as pre-painted steel, into an inverted U-shape to form the top and side walls of the case. The bottom wall of the case normally is formed separately and attached to the side walls and to a bottom frame that provides support for the entire refrigerator. The inner liners 16,17 conveniently are molded from a suitable plastic material to form the freezer compartment 11 and the fresh food compartment 12 respectively. Alternatively, the liners may be formed by bending and welding a sheet of a suitable metal, such as steel. The illustrative embodiment includes two separate liners 16,17 as it is a relatively large capacity unit and separate liners add strength and are easier to maintain within manufacturing tolerances. In smaller refrigerators, such as most top mount refrigerators for example, a single liner is formed and a mullion spans between opposite sides of the liner to divide it into a freezer compartment and a fresh food compartment.

In the illustrative refrigerator of FIG. 1, outer case 14 is constructed from a thin sheet of steel. The front portion of the side and top walls are bent over to form an inwardly projecting front flange 19. To enhance the stiffness of the case around the openings to the storage compartments 11,12, an elongated right angled stiffening or reinforcing member **19*a* extends along the inside of the corner between the side wall (such as 55 in FIG. 2) and the adjacent portion of the front flange 19**.

A breaker strip 20 extends between the case front flange and the outer front edges of the liners 16,17. Additional details of such a construction are shown and described in co-pending application SN. (9D-HR-18474) invented by Thomas Jenkins and assigned to General Electric Company, assignee of the present invention; which application is hereby included herein by reference. The breaker strip 20 is formed from a suitable resilient material, such as an extruded acrylo-butadiene-styrene based material (commonly referred to as ABS).

The insulation in the space between liners 16,17 is covered by another strip of suitable resilient material 21, which also commonly is referred to as the mullion. The mullion 21 also preferably is formed of an extruded ABS material. It will be understood that in a refrigerator with a separate mullion dividing an unitary liner into a freezer and a fresh food compartment, the front face member of that mullion corresponds to mullion 21. The breaker strip 20 and mullion 21 form the front face of the cabinet, and extend completely around the inner peripheral edges of the case and vertically between the liners 16,17.

Shelves 22 and drawers 23 normally are provided in the fresh food compartment to support items being stored therein. Similarly, shelves 24 and wire baskets 25 are provided in the freezer. In addition an ice maker 26 may be provided in the freezer.

A freezer door 28 and a fresh food door 29 close the access openings to the freezer and fresh food compartments 11,12 respectively. Each is mounted by a top hinge 30 and a bottom hinge, not shown, to rotate about its outer vertical edge between an open position, shown in FIG. 1, and a closed position closing the associated storage compartment.

Viewing FIGS. 1 and 3, freezer door 28 includes an outer panel made by folding a sheet of pre-painted steel to form a front wall 31; a peripheral wall 32 extending around and projecting perpendicular to the front wall to form the top, bottom and sides of the door; and an inner flange 33 projecting perpendicularly inward along the inner edge of the peripheral wall 32. An inner door panel 34, molded from a suitable plastic material, normally includes a peripheral flange (not shown, which overlies and is mounted to the flange 33 of the outer panel. The inner panel 34 also includes a wall 35 that projects away from the outer panel and is received within the freezer when the door is closed. The wall 35 supports removable shelves 36 for items to be stored. In addition the wall 35 can be provided with an ice dispenser 37. Conveniently the space between the inner and outer panels of the door 28 is filled with suitable foamed in place insulation 18.

Similarly fresh food door 29 includes an outer panel made by folding a sheet of pre-painted steel to form a front wall 41; a peripheral wall 42 extending around and projecting perpendicular to the front wall to form the top, bottom and sides of the door; and an inner flange 43 projecting perpendicularly inward along the inner edge of the peripheral wall 42. An inner door panel 44, molded from a suitable plastic material, normally includes a peripheral flange (not shown, which overlies and is mounted to the flange 43 of the outer panel. The inner panel 44 also includes a wall 45 that projects away from the outer panel and is received within the fresh food compartment when the door is closed. The wall 45 supports removable shelves 46 for items to be stored. In addition the wall 45 can be provided with a butter and cheese keeper 47. Conveniently the space between the inner and outer panels of the door 29 is filled with suitable foamed in place insulation 18.

A gasket 48 extends around the periphery of the freezer door 28 and a similar gasket 49 extends around the periphery of the fresh food door 29. Preferably each gasket overlies the junction of the outer and inner panels of that door. When the doors are closed the gaskets engage the cabinet front face around each of the storage compartments. Specifically, gasket 48 engages the part of breaker strip 20 above, below and to the outside of freezer liner 16 and the part of mullion adjacent the inner side of liner 16. Similarly, gasket 49 engages the part of breaker strip 20 above, below and to the outside of fresh food liner 17 and the part of mullion 21 adjacent the inner side of liner 17.

The gaskets seal between the doors and the front face of the cabinet against flow of air between the inside of the storage compartments and the surrounding atmosphere. However, as the insulation 18 is not continuous across the area of the gaskets, some thermal energy transfers between the compartments and the surrounding atmosphere through the area of the gaskets. One result is that portions of the cabinet and, in some instances portions of the doors, just outside the gaskets have a reduced temperature when the refrigerator is operating. If the temperature is lowered sufficiently these case and door portions can have a temperature lower than the dew point temperature of the surrounding air. In that event moisture from the air will condense on those portions the case and doors. In extreme cases enough moisture may condense to run down and drip on to the floor or other supporting surface. In any event, such condensation is unsightly and detracts from the appearance and operation of the refrigerator.

Such condensation tends to occur on the cabinet front face adjacent the outside edge of the gaskets 48,49. That is the outer edge of breaker strip 20 and the immediately adjacent portions of the side and top walls of case 14, which for this purpose can be considered part of the front face of the cabinet, and the portion of mullion 21 between the gaskets 48,49, as indicated at 51 in FIG. 3. Moisture does not tend to condense along the bottom of the case 14 nearly as often as the machinery compartment is at the bottom of the refrigerator and keeps the bottom of the case warmer. Normally the air flow along the peripheral walls of the doors near the sides and top of the refrigerator keeps them warm enough not to be subject to condensation. However, air flow between the adjacent facing portions of the peripheral door walls 32,42 next to the mullion 21 is restricted and these portions of the peripheral walls tend to be subject to condensation.

Many times such condensation could be prevented by making the insulation around the liners thicker and the gaskets wider. However, this has the distinct disadvantage of decreasing the usable volume in a refrigerator of a given external size. In fact it is desired to reduce the insulation thickness so that the usable space in a given case size is maximized. It is common in the prior art to provide extra heat to the areas or portions of the cabinet subject to condensation in order to keep their temperature above the dew point temperature of the surrounding air. Most often this takes the form of either an elongated electric heating element or a length of conduit connected in the refrigeration system to carry hot refrigerant, called a hot gas loop. Either approach has a number of deficiencies, such as those discussed above.

I have found that a sheet or strip of material of high heat conductivity held in intimate contact with the inside of the outer case or door at least adjacent to, and preferably overlapping, the portion of the cabinet subject to condensation and projecting onto the adjacent area of the case or door having a temperature above the dew point temperature of the surrounding air will raise the temperature of the portion otherwise subject to condensation and condensation will be eliminated or at least significantly reduced to the point that it does not create a problem. Preferably the strip is joined to the inside surface of the appropriate area of the case or door by a thin layer of suitable adhesive before the insulation 18 is foamed in place. A minimum amount of adhesive is used in order to secure the sheet against movement by the insulation during the foaming process while not significantly degrading the thermal conductivity provided by the intimate contact between the sheet and the case or door surface on which it is mounted. Preferably the sheet has a thermal conductivity between about 60 and 230 British Thermal Units (BTU's) per hour/foot/degree. Preferably the sheet extends along substantially the entire length of the cabinet portion subject to condensation and projects at least about an inch onto an adjacent area of the case or door that is above the dew point temperature of the surrounding air. Preferably the sheet is formed form a metal foil having a thickness between about 0.005 and 0.05 inch. Presently aluminum foil and copper foil are preferred in light of performance and cost.

Referring to FIG. 2, a suitable strip of foil 54 is in intimate contact with the inside surface of case side wall 55. It extends along substantially the entire length of side wall 55 adjacent freezer liner 16, or at least along substantially the entire length of the area or portion subject to condensation. The front portion of strip 54 is sandwiched between side wall 55 and stiffening member 19*a*. The sheet 54 is sufficiently wide to project at least about one inch onto the adjacent area of wall 55 that is above the dew point temperature of the surrounding air during normal operation of the refrigerator. It will be understood that similar strips of metal foil can be secured to the top and other side of the case 14 if needed to prevent condensation in those areas. Such strips have not been illustrated for the sake of simplicity.

Referring now to FIG. 3, it will be seen that a suitable sheet or strip of metal foil 57 is in intimate contact with the inner surface of door 28. It overlies the peripheral wall 32 and projects outward onto the front wall 31 sufficiently that it is intimate contact with a substantial portion of wall 31 having a temperature above the dew point temperature of the surrounding air. Preferably strip 57 extends along substantially the entire length of wall 32, or at least substantially the entire length of the portion subject to condensation. Preferably the strip projects onto front wall 31 at least about one inch into the area of wall 31 above the dew point temperature of the surrounding air.

A similar sheet or strip of metal foil 58 is in intimate contact with the inner surface of door 29. It overlies the peripheral wall 42 and projects outward onto the front wall 41 sufficiently that it is intimate contact with a substantial portion of wall 41 having a temperature above the dew point temperature of the surrounding air. Preferably strip 58 extends along substantially the entire length of wall 42, or at least substantially the entire length of the portion subject to condensation. Preferably the strip projects onto front wall 41 at least about one inch into the area of wall 41 above the dew point temperature of the surrounding air.

The mullion 21 is isolated from flow of the surrounding air and is remote from areas of the case and doors having temperatures above the dew point temperature of the surrounding air. Therefore, application of strips of material of high thermal conductivity on the inside of the mullion front face normally will be ineffective in maintaining the temperature of the front face of the mullion above the dew point temperature. Thus, if the mullion is subject to condensation, a heater normally will be installed in the mullion. It is difficult to run such a heater to the very top and bottom ends of the mullion. Strips of high thermal conductivity can be used in conjunction with such a heater to assure that moisture does not condense at the ends of the mullion. Referring to FIG. 1, a sheet or strip 59 of suitable metal foil is positioned at the top and bottom of the mullion, in intimate contact with the inside of the mullion 21 and the adjacent portions of the breaker strip 20. More specifically, each strip 59 is "T" shaped with the base of the T extending into the mullion and the cross-arm extending along the breaker strip to each side of the mullion.

It will be understood that the particular portions of the front face (including the immediately adjacent portions of the case top and side walls) and the portions of the adjacent facing peripheral walls of the doors potentially subject to condensation in any individual refrigerator will depend upon a numerous design factors of the particular refrigerator and on the atmospheric environment in which it may be operated. Thus a manufacturer will empirically determine the location, size and shape of such areas or portions for each of its refrigerator designs.

FIG. 4 illustrates, in somewhat schematic form, the upper right corner of a refrigerator without a stiffening member 19*a*. The front portion of the outer case side wall 60 is bent inwardly to form the front face 61. The liner side wall 62 stops short of the front face 61 and is joined to the case side wall 60 by a breaker strip 63. The space between the side wall 60, liner wall 62 and breaker strip 63 is filled with insulation 18. The door 64 carries a gasket 65 that seals the door to the front face 61 when that door is closed. A strip 66 of high thermal conductivity material, such as an appropriate metal foil, is in intimate contact with the inside of the case side wall. It extends across the front face 61 and along the side of the cabinet sufficiently to overlie at least about an inch of the adjacent area of the case side wall having a temperature above the dew point temperature of the surrounding air.

While specific embodiments of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator comprising;

an outer case comprising a top wall and side walls;

an inner liner defining a storage compartment with a front opening;

a face adjacent said front opening;

a door selectively engaging said face for closing said front opening;

at least a portion of said face being so disposed that operation of said refrigerator tends to cool said portion of said face to a temperature below the dew point temperature of the surrounding air; and a thin sheet of material having a high thermal conductivity positioned in substantial surface contact with a inside surface of a side wall of said case, said sheet of material being a metal foil, an edge of said material disposed proximate said face portion and said material projecting from said face portion onto an area of said case side wall having a temperature above the dew point temperature of the surrounding air for assuring that a temperature of said face portion is above the dew point temperature of the surrounding air.

2. A refrigerator as set forth in claim 1, wherein: said sheet of material has a thermal conductivity between about 60 and 230 BTU's per hour/foot/degree Fahrenheit.

3. A refrigerator as set forth in claim 1, wherein: said metal foil has a thickness between about 0.005 and 0.05 inch.

4. A refrigerator as set forth in claim 1, wherein: said sheet of metal foil is formed from a metal selected from the group consisting of aluminum and copper.

5. A refrigerator as set forth in claim 4, wherein: said sheet of material has a thickness between about 0.005 and 0.05 inch.

6. A refrigerator comprising:

an outer case;

liner means positioned within said case and defining a plurality of storage compartments, each of said compartments having a front opening;

a front face adjacent a periphery of each of said compartment front openings;

a plurality of doors for closing said compartment front openings, each of said doors including a front wall and a peripheral wall;

said peripheral wall of each door being positioned adjacent to said front face when that door closes the corresponding compartment front opening;

at least a portion of said door peripheral walls being so disposed that operation of said refrigerator tends to cool said portion of said door peripheral walls to a temperature below a dew point temperature of surrounding air; and a thin sheet of material having a high thermal conductivity positioned in substantial surface to surface contact with an inside surface of said portion of at least one of said door peripheral walls and extending along substantially an entire length of said wall and projecting onto an inside surface of said front wall having a temperature above the dew point temperature of the surrounding air for assuring that said portion of said peripheral door side walls has a temperature above the dew point temperature of the surrounding air.

7. A refrigerator as set forth in claim 6, wherein: said sheet of material has a thermal conductivity between about 60 and 230 BTU's per hour/foot/degree Fahrenheit.

8. A refrigerator as set forth in claim 7, wherein: said sheet of material is a metal foil.

9. A refrigerator as set forth in claim 8, wherein: said metal foil has a thickness between about 0.005 and 0.05 inch.

10. A refrigerator as set forth in claim 8, wherein: said sheet of metal foil is formed from a metal selected from the group consisting of aluminum and copper.

11. A refrigerator as set forth in claim 10, wherein: said sheet of material has a thickness between about 0.005 and 0.05 inch.

12. A refrigerator comprising:

an outer case;

liner means positioned within said case and defining a plurality of storage compartments, each of said compartments having a front opening;

a front face adjacent a periphery of each of compartments front openings;

a mullion positioned between said pair of compartments, said mullion comprising opposing ends and a front forming part of said front face;

a pair of doors for closing said compartment front openings, each of said doors including a front panel and a peripheral wall;

said peripheral wall of each door being positioned adjacent to said front face when that door closes the corresponding compartment front opening;

a corresponding portion of said peripheral wall of each of said doors closing said adjacent pair of compartment front openings being adjacent said mullion front when that door is closed;

operation of said refrigerator tending to cause a portion of said mullion front surface to have a temperature below a dew point temperature of surrounding air;

a thin sheet of metal being positioned in substantial surface to surface contact with an inside surface of one end of said mullion and projecting onto an inside surface of said front face having a temperature above the dew point of the surrounding air for assuring that said mullion portion has a temperature above the dew point temperature of the surrounding air.

13. A refrigerator as set forth in claim 12, wherein: said sheet of material has a thermal conductivity between about 60 and 230 BTU's per hour/foot/degree Fahrenheit.

14. A refrigerator as set forth in claim 13, wherein: said sheet of material is a metal foil.

15. A refrigerator as set forth in claim 14, wherein: said metal foil has a thickness between about 0.005 and 0.05 inch.

16. A refrigerator as set forth in claim 14, wherein: said sheet of metal foil is formed from a metal selected from the group consisting of aluminum and copper.

17. A refrigerator as set forth in claim 16, wherein: said sheet of material has a thickness between about 0.005 and 0.05 inch.

* * * * *